US005741032A

United States Patent [19]

Chaput

[11] Patent Number: 5,741,032

[45] Date of Patent: Apr. 21, 1998

[54] SASH LOCK

[75] Inventor: Ivanhoe E. Chaput, Torrence, Calif.

[73] Assignee: Reflectolite Products Company, Inc., Sun Valley, Calif.

[21] Appl. No.: 902,830

[22] Filed: Jul. 30, 1997

Related U.S. Application Data

[63] Continuation of Ser. No. 666,599, Jun. 18, 1996, abandoned.

[51] Int. Cl.[6] ..... E05C 3/04

[52] U.S. Cl. ..... 292/202; 292/240

[58] Field of Search ..... 292/202–204, 292/DIG. 20, 35, 38, 17, 240, 241

[56] References Cited

U.S. PATENT DOCUMENTS

| | | | |
|---|---|---|---|
| 749,469 | 1/1904 | Assorati | 292/204 |
| 797,768 | 8/1905 | Fisher | 292/204 |
| 1,122,026 | 12/1914 | O'Rourke | 292/204 |
| 1,338,250 | 4/1920 | Parkes | 292/204 |
| 1,900,936 | 3/1933 | Huttger | 292/202 |
| 2,581,816 | 1/1952 | Schlueter | 292/204 |
| 2,749,163 | 6/1956 | Loeb | 292/17 |
| 3,103,378 | 9/1963 | Ahlgren | 292/DIG. 38 |
| 3,135,542 | 6/1964 | Wilkinson | 292/204 |
| 3,645,573 | 2/1972 | Strang | 292/241 |
| 3,690,132 | 9/1972 | Engstrom | 292/DIG. 38 |
| 3,811,718 | 5/1974 | Bates | 292/241 |
| 4,736,972 | 4/1988 | Mosch | 292/204 |
| 4,801,164 | 1/1989 | Mosch | 292/204 |
| 4,826,222 | 5/1989 | Davis | 292/241 |
| 5,042,855 | 8/1991 | Bennett et al. | 292/241 |
| 5,161,839 | 11/1992 | Piltingsrud et al. | 292/241 |
| 5,244,238 | 9/1993 | Lindqvist | 292/7 |

FOREIGN PATENT DOCUMENTS

| | | | |
|---|---|---|---|
| WO 94/18425 | 2/1993 | WIPO | 292/DIG. 47 |

OTHER PUBLICATIONS

Allen–Stevens—The World's #1 Supplier of Sash Locks, Door & Window Hardware.

*Primary Examiner*—Steven N. Meyers
*Assistant Examiner*—Gary Estremsky
*Attorney, Agent, or Firm*—Hill, Steadman & Simpson

[57] ABSTRACT

The present invention provides a sash lock for double hung windows. The sash lock is fabricated without a spring for biasing the cam into a closed or open position and further without a screw or fastening means to secure the lever, housing and cam together. The four primary components of the sash lock, specifically the lever, housing, cam and keeper mount may be fabricated from injection molded plastic as opposed to metallic materials.

16 Claims, 2 Drawing Sheets

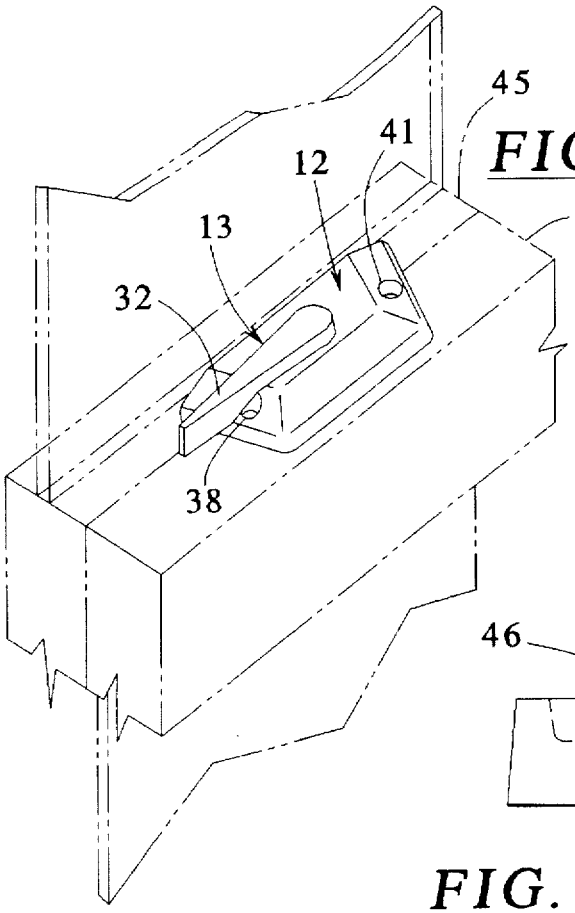
FIG. 2
FIG. 3
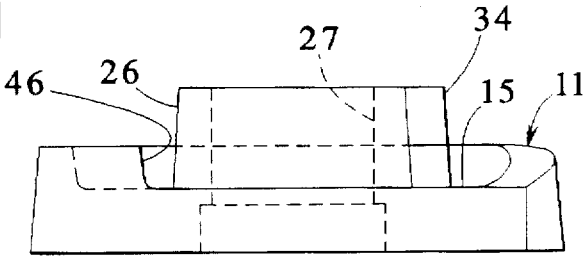
FIG. 4
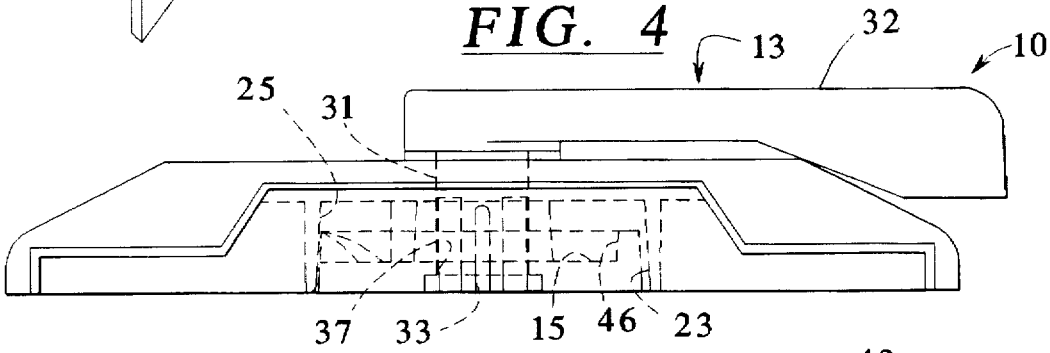
FIG. 5
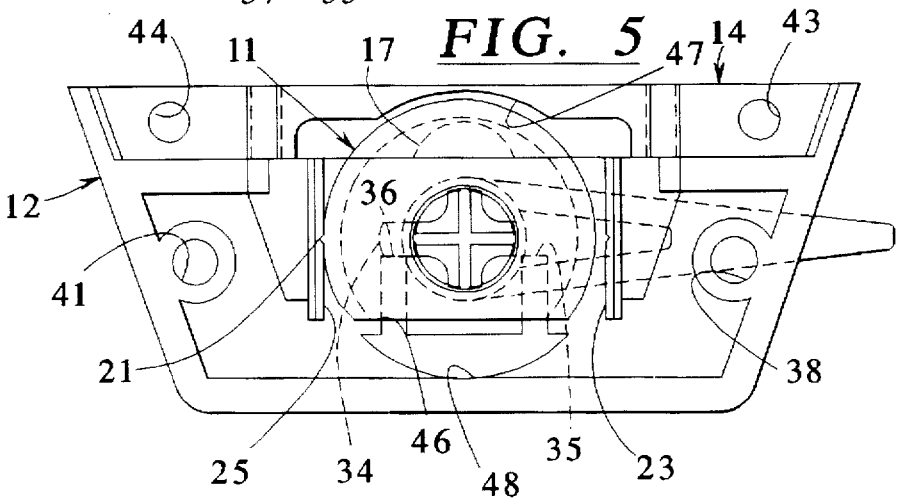

SASH LOCK

This is a continuation of application Ser. No. 08/666,599, Jun. 18, 1996 now abandoned.

BACKGROUND OF THE INVENTION

The present invention relates generally to window locks, and more particularly, to sash locks for double hung windows.

Double hung windows include a pair of sliding window panes, commonly referred to as sashes, that are generally movable along parallel paths within the window frame. The window may be opened by sliding one sash into an overlapping position with respect to the other sash. Typically, such an operation includes raising or lowering the inner sash, i.e., the sash that is disposed along the planar path closest to the interior side of the building. In order to prevent unauthorized entry through the window opening, a lock system must be provided so that the inner sash cannot be moved with respect to the outer sash. Typically, a sash lock is provided which secures the top edge of the inner sash against the lower edge of the outer sash.

Historically, sash locks have been primarily made of metal such as die cast zinc. Die casting is a relatively expensive process. There are two primary components to the finished product, the lock, which includes multiple parts and the keeper. Typically, a lock includes a lever, a housing, a cam and a spring to bias the cam in either an open or a closed position. The keeper is typically a unitary piece of metal which is grabbed by the cam when the cam is rotated from an open position to a closed position. In addition, a screw is often required to hold the housing, lever, cam and spring together. The spring is required to bias the cam into an open or a closed position.

Therefore, there is a need for sash locks that are both less expensive to manufacture and reliable. Further, there is also a need for sash locks that are made of a material that is less expensive than die cast zinc. Still further, there is a need for sash locks that are made from fewer parts than sash locks known in the art.

SUMMARY OF THE INVENTION

The present invention provides an improved sash lock that is fabricated from as few as four parts, not including the screws that are used to mount the keeper and the housing onto the inner and outer sashes. Specifically, the sash lock of the present invention includes a keeper of a typical design and a lock mechanism comprising a rotatable cam disposed within a housing. The cam includes an outer surface which includes an outward projection. The cam also includes an inner surface that defines a channel for accommodating the keeper as the cam has been rotated into the closed position.

The housing includes two recesses for accommodating the projection disposed on the outer surface of the cam. A first recess is provided and is positioned to accommodate the projection disposed on the outer surface of the cam when the cam has been rotated to the open position. The second recess is positioned to accommodate the projection disposed on the outer surface of the cam when the cam has been rotated to the closed position. In the closed position, the cam has been rotated around so that the keeper is disposed within the channel defined by the inside surface of the cam. A lever mechanism is utilized to secure the cam underneath the housing and to facilitate the turning of the cam.

In an embodiment, the present invention provides a sash lock assembly that does not require a separate spring mechanism for biasing the cam in an open or a closed position.

In an embodiment, the present invention provides an improved sash lock assembly whereby the engagement between the cam and the interior wall disposed within the housing, and more specifically the engagement between the projection disposed on the outside surface of the cam and the recesses disposed along the interior wall of the housing, provides an audible click when the cam is moved into or out of the open position or when the cam is moved into or out of the closed position.

In an embodiment, the present invention provides an improved sash lock assembly whereby the lever is utilized to secure the cam underneath the housing thereby eliminating any additional attachment means in the form of a screw or other fastener for holding the lever, housing and cam together.

In an embodiment, the present invention provides an improved sash lock assembly whereby one or more parts may be made of molded plastic.

In an embodiment, the present invention provides an improved sash lock assembly whereby the keeper, lever, housing and cam all may be fabricated from molded plastic.

In an embodiment, the present invention provides an improved sash lock assembly whereby the housing includes two spaced apart interior walls, each wall including a slot or recess for accommodating a projection disposed on the outside surface of the cam. One of said recesses accommodates the projection disposed on the outside surface of the cam when the cam is in a closed or locked position. The other of said recesses accommodates the projection disposed on the outside surface of the cam when the cam is in an open or unlocked position.

In an embodiment, the present invention also provides a method of fabricating a sash lock. The method includes separately molding the keeper, cam, housing and lever portions from plastic. The cam is then placed underneath the housing in a hole disposed and a central portion of the cam is aligned with a hole disposed in the top surface of the housing. The shaft of the lever is then inserted downward through the hole in the housing and into the hold disposed in the cam. The shaft and the hole disposed in the cam are sized so that the cam is fixably mounted onto the end of the shaft. The shaft and the hole disposed in the housing are sized so that the shaft is free to rotate.

In an embodiment, the lever, housing and keeper are fabricated from colored molded plastic which eliminates the need for subsequent painting of the parts.

An advantage of the present invention is that it provides an improved sash lock assembly which is fabricated from only four working parts: a keeper, a lever, a cam and a housing.

Another advantage of the present invention is that it provides an improved sash lock assembly which does not require a spring to bias the cam in either a closed or open position.

Another advantage of the present invention is that it provides an improved sash lock assembly that may be fabricated from molded plastic parts.

Another advantage of the present invention is that it provides an improved sash lock assembly that may be fabricated from colored molded plastic which does not require subsequent painting or coating.

Still another advantage of the present invention is that it provides an improved sash lock assembly that does not require a separate screw, bolt or fastener to hold the cam, housing and lever portions together.

Another advantage of the present invention is that it provides an improved method for fabricating sash lock assemblies from molded plastic parts.

Additional features and advantages of the present invention are described in, and will be apparent from, the detailed description of the presently preferred embodiments and from the drawings.

BRIEF DESCRIPTION OF THE DRAWINGS

FIG. 2 is a perspective view of a sash lock assembly mounted on a double hung window.

FIG. 3 is a side view of the cam of the sash lock assembly shown in FIG. 1.

FIG. 4 is a side view of the sash lock assembly illustrated in FIG. 1.

FIG. 5 is a bottom plan view of the sash lock assembly shown in FIG. 1.

DETAILED DESCRIPTION OF THE PRESENTLY PREFERRED EMBODIMENTS

Figure 1:
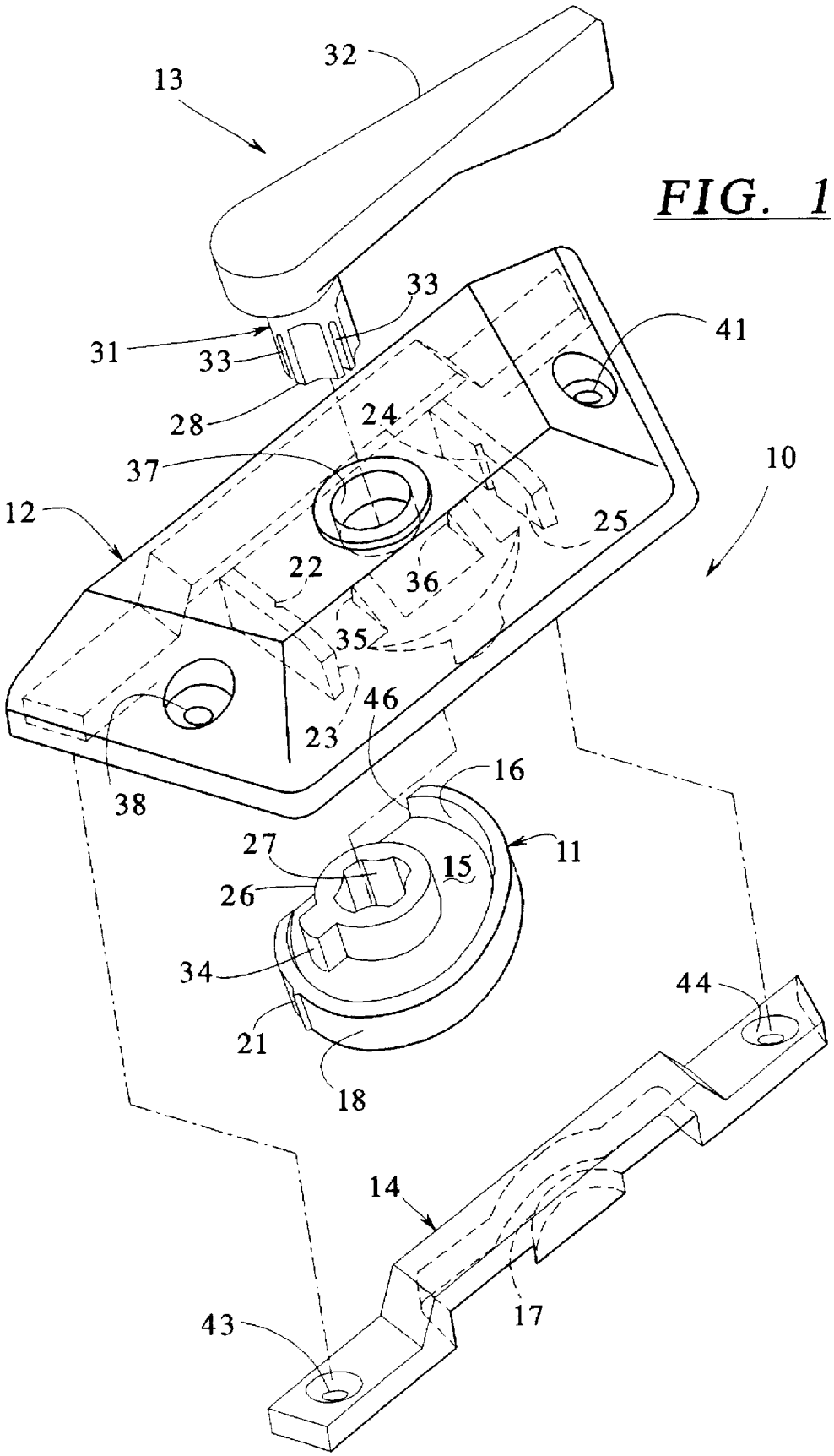
FIG. 1 is an exploded view of a sash lock assembly fabricated in accordance with the present invention.

The present invention is best understood upon consideration of prior art sash lock assemblies. Specifically, prior art sash lock assemblies are normally made of metal, and, for the most part, from die cast zinc. Further, prior art sash lock assemblies rely upon a spring or other biasing mechanism to bias or retain the cam into either a closed or an open position. Further, prior art sash lock assemblies normally require a separate screw, bolt or other fastening means to hold the lever, housing, cam and spring portions together.

In contrast, the lock assembly 10 of the present invention, as shown in FIG. 1, does not require a separate spring to bias the cam 11 into an open or closed position or a separate fastening means to attach the cam 11, housing 12 and lever 13 together. Further, the sash lock assembly 10 comprises only four parts: the cam 11, the housing 12, the lever 13 and the keeper mounting 14. The operation of sash lock assembly 10 is as follows.

As illustrated in FIG. 1, the cam 11 includes a channel 15 defined by the inside surface 16. The channel 15 accommodates the keeper 17 when the cam 11 has been twisted into the closed position. The cam 11 can be biased into two positions—open and closed. Specifically, the outer surface 18 of the cam 11 includes at least one projection 21. The projection 21 is accommodated in the recess 22 disposed in the interior wall 23 of the housing 12 when the cam 11 is in an open or unlocked position. In contrast, the projection 21 is disposed in the recess 24 of the interior wall 25 of the housing 12 when the cam 11 has been rotated to the closed or locked position. The walls 23, 25 are elastic so that the projection 21 snaps into the open and locked positions.

Still referring to the cam 11, a cylindrical body portion 26 extends upward from the channel 15 and includes an irregularly shaped opening 27 for snugly and frictionally accommodating the lower end 28 of the shaft 31 that extends downward from the handle portion 32 of the lever 13. The lower end 28 of the shaft 31 includes a plurality of slots shown at 33. The slots collapse slightly as the shaft 31 is forced downward into the opening 27 of the cam 11. The forceful insertion of the shaft 31 down into the opening 27 of the cam 11 and the resilience of the material which urges the slots to attempt to reopen providing an interference fit which insures that the cam 11 is securely mounted onto the end 28 of the shaft 31.

The cylindrical body 26 of the cam 11 also includes an outwardly projecting tab shown at 34. The tab 34 engages the stop surface 35 disposed under the housing 12 and prevents the cam 11 from being twisted too far beyond the open position. Similarly, when the cam 11 is in the closed position (See FIG. 5), the tab 34 will engage the stop surface 36 to prevent the cam 11 from being twisted too far beyond the closed position.

As illustrated in FIG. 1, the top portion of the housing 12 includes a hole 37 for rotatably accommodating the shaft 31. The housing 12 also includes one or more recessed screw holes shown at 38, 41 for attaching the housing 12 to a window sash 42 as illustrated in FIG. 2. Similarly, the keeper mount 14 includes one or more recessed through holes shown at 43, 44 for attaching the keeper mount to a window sash 45 as illustrated in FIG. 2.

As illustrated in FIG. 3, the cam 11 features a channel 15 defined by the space between the inside wall surface 16 which extends concentrically around the cylindrically shaped body 26. The body 26 defines the irregularly shaped hole 27 for accommodating the lower end 28 of the shaft 31 of the lever 13. The cam 11 also features a leading edge 46 which hooks around the keeper surface 17 before the cam 11 is rotated into the closed position as shown in FIG. 5. As illustrated in FIG. 5, the keeper mount 14 includes a recess 47 and the housing 12 includes a similar recess 48 for accommodating the cam 11 throughout its rotation.

As noted above, each separate component, namely the lever portion 13, the housing 12, the cam 11 and the keeper mount 14 may be fabricated from molded plastic such as injection molded plastic. Suitable polymers will be apparent to those skilled in the art. Using colored plastics can also eliminate the need for painting or coating the parts after fabrication. A method of fabricating the sash lock 10 in accordance with the present invention is provided which includes the molding of the lever 13, housing 12, cam 11 and keeper mount 14. Then the cam 11 is disposed underneath the housing in the position illustrated in FIGS. 1, 4 and 5. The shaft 31 of the lever 13 is then passed through the hole 37 disposed in the housing 12 and downward into the irregularly shaped hole 27 disposed in the cam 11. The lower end 28 of the shaft 31 is preferably sized so that it must be forced into the irregularly shaped hole 27 to provide a secure frictional fit. Then the assembled component comprising the lever 13, cam 11 and housing 12 may be packaged with the keeper mount 14 and forescrewed for installation.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed:

1. A sash lock comprising:

a keeper, a lock mechanism comprising a rotatable cam disposed within a housing, the cam comprising an outer circumferential surface, the outer circumferential surface comprising an outward projection that extends outward therefrom, the cam further comprising a channel for accommodating the keeper, the housing having integral therewith two elongated walls that are parallel in a lengthwise direction that extend downward from an under surface of the housing, the walls being fixedly attached continuosly along a lengthwise edge of each wall to the housing, the cam being disposed between the parallel walls, one of said walls having a first recess and the other of said walls having a second recess for accommodating the projection, the walls being sufficiently resilient so that the projection is biased into the first recess when the cam is in an open position and the projection is biased into the second recess when the cam is in a closed position.

2. The lock of claim 1, wherein the only spring mechanism for biasing the cam in the open position is the engagement of the projection of the cam with the first recess and no other spring element is disposed between the housing and the cam.

3. The lock of claim 1, wherein the only spring mechanism for biasing the cam in the closed position is the engagement of the projection of the cam with the second recess and no other spring element is disposed between the housing and the cam.

4. The lock of claim 1, wherein an audible sound is produced when the projection disposed on the cam is moved into or out of one of said recesses disposed on the housing.

5. The lock of claim 1 further comprising a lever, the lever comprising a handle portion disposed above the housing and a shaft extending downward through the housing and though the cam, the cam being attached to the shaft.

6. The lock of claim 1 further comprising a lever, the lever comprising a handle portion disposed above the housing and a downwardly extending shaft, the shaft extending downward through and being rotatably engaged in a hole disposed in the housing, the shaft extending downward though and being fixably engaged in a hole disposed in the cam.

7. The lock of claim 1, wherein the housing comprises a unitary piece of molded plastic.

8. The lock of claim 1, wherein the cam comprises a unitary piece of molded plastic.

9. The lock of claim 1, wherein the lever comprises a unitary piece of molded plastic.

10. A sash lock assembly comprising:

a keeper, and a lock mechanism comprising a rotatable cam disposed under a housing and a lever comprising a downwardly extending shaft for rotating the cam about an axis defined by the shaft and for securing the cam under the housing, the cam extending radially outward from the handle shaft and terminating at an outer circumferential surface, the outer circumferential surface having an outward projection disposed on the outer circumferential surface, the cam further comprising a channel for accommodating the keeper, the housing having integral therewith two enlongated walls that are parallel in a lengthwise direction that extend downward from and are fixedly attached continuously along the lengthwise edge of each wall to an underside of the housing, the cam being disposed between the two interior walls, each of said walls including a recess for accommodating the projection, the walls being sufficiently resilient so that the projection is biased into one recess when the cam is in an open position and the keeper is not disposed within the channel of the cam and the projection is biased into the other recess when the cam is in a closed position and the keeper is disposed within the channel of the cam, the lever comprising a handle portion disposed above the housing that is connected to the downwardly extending shaft that extends through the housing and the cam, the shaft extending downward through and being rotatably engaged in a hole disposed in the housing, the shaft extending downward through a hole disposed in the cam.

11. The lock assembly of claim 10, wherein the only spring mechanism for biasing the cam in the open position is the engagement of the projection of the cam with the first recess and no other spring element is disposed between the housing and the cam.

12. The lock of claim 10, wherein the only spring mechanism for biasing the cam in the closed position is the engagement of the projection of the cam with the second recess and no other spring element is disposed between the housing and the cam.

13. The lock of claim 10, wherein an audible sound is produced when the projection disposed on the cam is moved into or out of one of said recesses disposed on the housing.

14. The lock of claim 10, wherein the housing comprises a unitary piece of molded plastic.

15. The lock of claim 10, wherein the cam comprises a unitary piece of molded plastic.

16. The lock of claim 10, wherein the lever comprises a unitary piece of molded plastic.

* * * * *